US007533554B2

(12) United States Patent
Cortese

(10) Patent No.: US 7,533,554 B2
(45) Date of Patent: May 19, 2009

(54) SUPPORT DEVICE FOR CUTTING TEMPLATES

(75) Inventor: Carmelo Angelo Cortese, Sasso Marconi (IT)

(73) Assignee: Cortese S.p.A., Bologna (IT)

( * ) Notice: Subject to any disclaimer, the term of this patent is extended or adjusted under 35 U.S.C. 154(b) by 1048 days.

(21) Appl. No.: 10/489,981

(22) PCT Filed: Oct. 8, 2003

(86) PCT No.: PCT/IT03/00603

§ 371 (c)(1),
(2), (4) Date: Mar. 17, 2004

(87) PCT Pub. No.: WO2004/043660

PCT Pub. Date: May 27, 2004

(65) Prior Publication Data

US 2005/0230595 A1 Oct. 20, 2005

(30) Foreign Application Priority Data

Nov. 14, 2002 (IT) ..... BO2002A0718

(51) Int. Cl.
*B21D 31/00* (2006.01)

(52) U.S. Cl. ..... 72/379.2

(58) Field of Classification Search ..... 269/289 R; 72/379.2

See application file for complete search history.

(56) References Cited

U.S. PATENT DOCUMENTS 1,467,787 A * 9/1923 Gemmill ..... 72/324

FOREIGN PATENT DOCUMENTS

| | | | |
|---|---|---|---|
| BE | 691 312 A | | 5/1967 |
| DE | 34 03 323 A | | 8/1985 |
| DE | 198 55 127 A | | 5/2000 |
| GB | 332 073 A | | 7/1930 |
| GB | 620 552 A | | 3/1949 |
| GB | 620552 | * | 3/1949 |
| JP | 01095818 A | * | 4/1989 |

* cited by examiner

*Primary Examiner*—Dana Ross
*Assistant Examiner*—Debra M Sullivan
(74) *Attorney, Agent, or Firm*—McGlew and Tuttle, P.C.

(57) ABSTRACT

The support device for cutting templates comprises a panel (2) with an essentially rectangular shape and presenting along the longitudinal sides respective raised rims (3) that serve as guides for sliding it into a cutting machine. The longitudinal rims (3) are fitted with an edge (4) that is folded towards the center of the panel (2), presenting the respective bevels (5) at the opposite ends in the corners. The panel (2) has a front rim (6) produced by folding the same panel (2) in a single piece and destined to function as the support device's handle.

16 Claims, 3 Drawing Sheets

FIG. 2
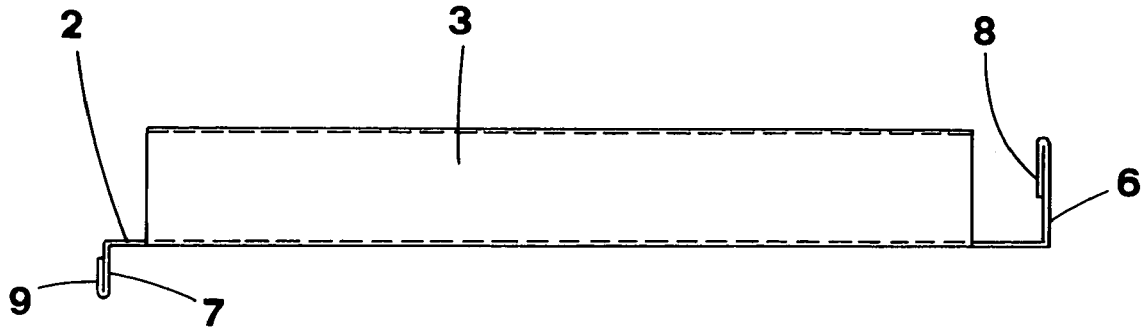
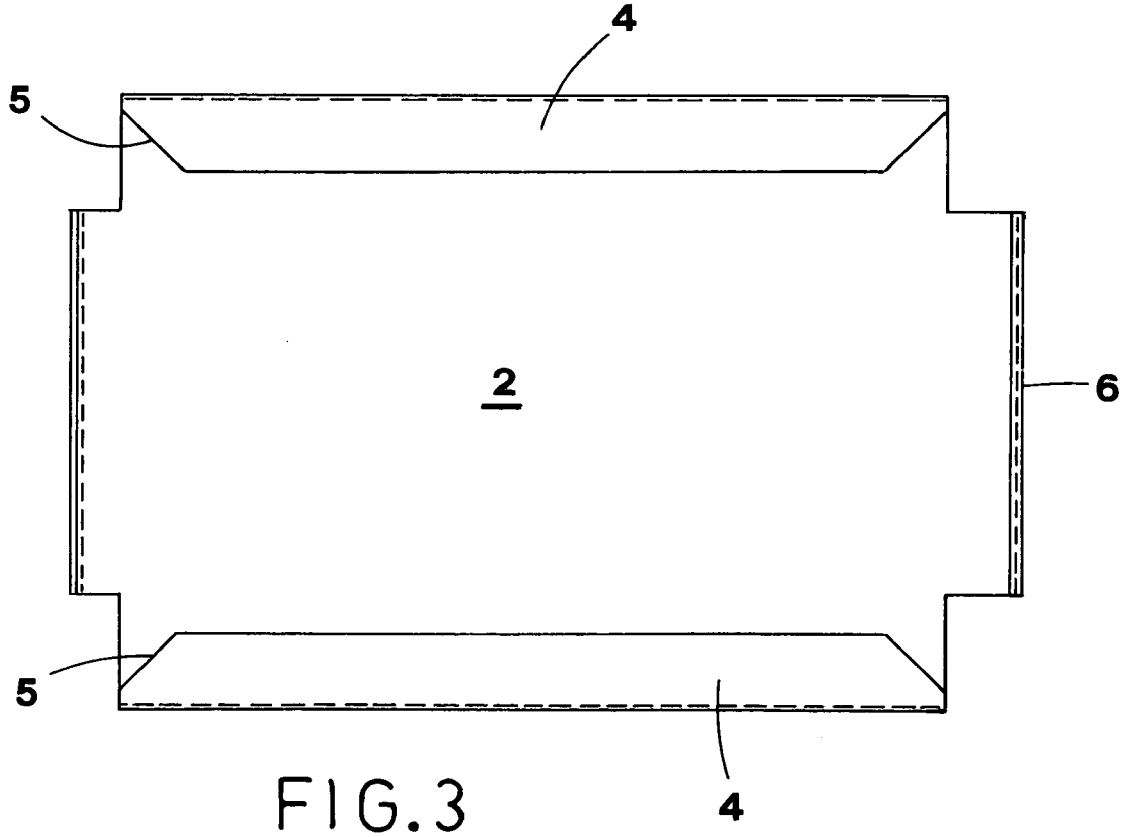
FIG. 3

FIG. 4
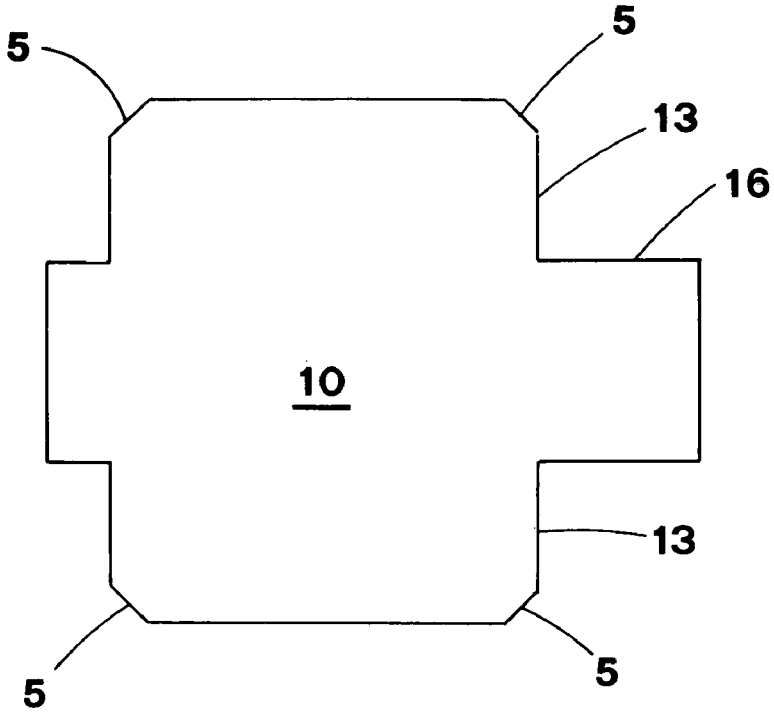
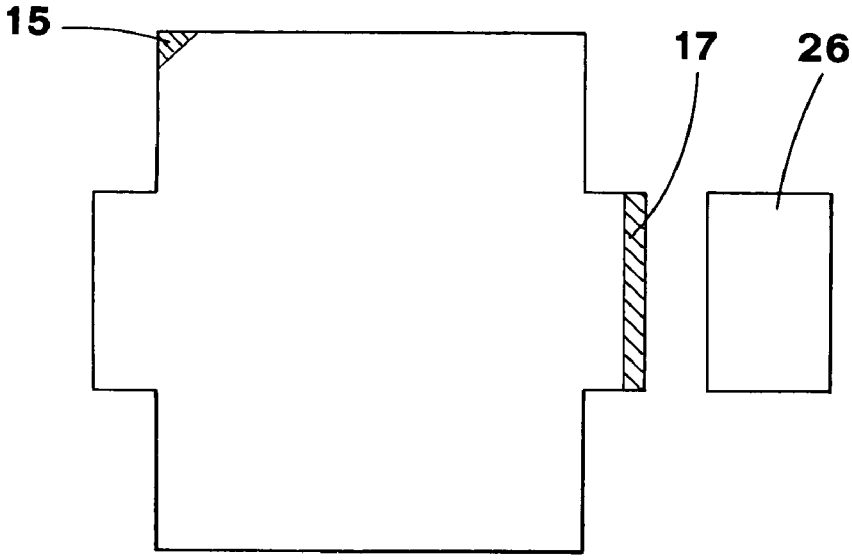
FIG. 5

SUPPORT DEVICE FOR CUTTING TEMPLATES

TECHNICAL FIELD

The following invention regards a support device for cutting templates, destined in particular to be applied in machines for cutting tubular-shaped textile goods.

BACKGROUND ART

Machines that cut tubular textile goods following suitable outlines in order to produce underwear and similar are currently known. Such machine are constituted substantially by a press, which has a special cutting template or plate applied to the mobile part, with an outline that corresponds to the garment to be produced. The textile goods to be cut are introduced onto the machine's surface and then undergo the action of the press that cuts them using the abovementioned template.

The cutting templates are joined to a support device commonly known as a template holder. According to a known type, the cutting template support device is constituted by a panel obtained from a suitably-shaped metal sheet, as shown as an example in FIG. 5. The sheet is cut according to the required perimeter, for example by laser machines, and then folded in such a way as to form a type of drawer. The drawer panel therefore presents raised rims along the respective sides; the longitudinal rims have an edge folded towards the centre of the panel, in order to form a type of guide for being slid onto the press. The panel also has a grip handle fixed on a corresponding transversal rim, for example by means of welding. The cutting template is fixed on the outer face of the support panel.

The abovementioned cutting template support devices have various inconveniences that make its use expensive and unpractical. In particular, the support devices of the known type have a relatively high price, due primarily to the material from which they are made and the time and work processes required to manufacture them. It should be remembered that such support devices represent a consumable material for the machine as they must be replaced with a certain frequency, due primarily to the wear to which they are subject, and therefore in time related costs can reach a somewhat high overall value.

The template holder devices of the known type are also awkward to use and can be dangerous for those operating them as they require manual handling in order to be introduced into the machine. In particular, the corners of the abovementioned longitudinal rims represent a potential hazard.

DISCLOSURE OF INVENTION

The aim of the present invention is to resolve the abovementioned drawbacks by devising a support device for cutting templates that makes it possible to considerably reduce production costs.

Within the ambit of this task, a further aim of the present invention is to provide a support device for cutting templates that is easy to use and safe for the operator.

A further aim of the invention is that of providing a support device that is of simple conception, certainly reliable function and versatile in use.

The abovementioned objectives can be achieved by this present support device for cutting templates characterized in that it comprises a substantially rectangular-shaped panel, obtained by folding a metal sheet flat according to a predetermined shaped profile and presenting along the respective longitudinal sides respective raised rims, serving as guides for sliding it into the cutting machine, characterized by the fact that on said metal sheet, in the outer corners of opposite portions destined to form said longitudinal rims, there are respective bevels that reduce the perimeter of said shaped outline of the metal sheet, said longitudinal rims being respectively fitted with an edge folded towards the centre of said panel, presenting said bevels in the corners of the opposite ends.

BRIEF DESCRIPTION OF THE DRAWINGS

Description details of the invention shall be further evident in the illustrations of a preferred type of a support device for cutting templates, in the guideline drawings attached and wherein:

FIG. 2 illustrates a lateral view of said support device;

FIG. 3 illustrates a corresponding plan view;

FIG. 4 shows a view of the plan development of a shaped sheet of metal for the creation of the support device in object;

FIG. 5 illustrates a corresponding view of the plan development of a conventional support device.

MODES FOR CARRYING OUT THE INVENTION

Figure 1:
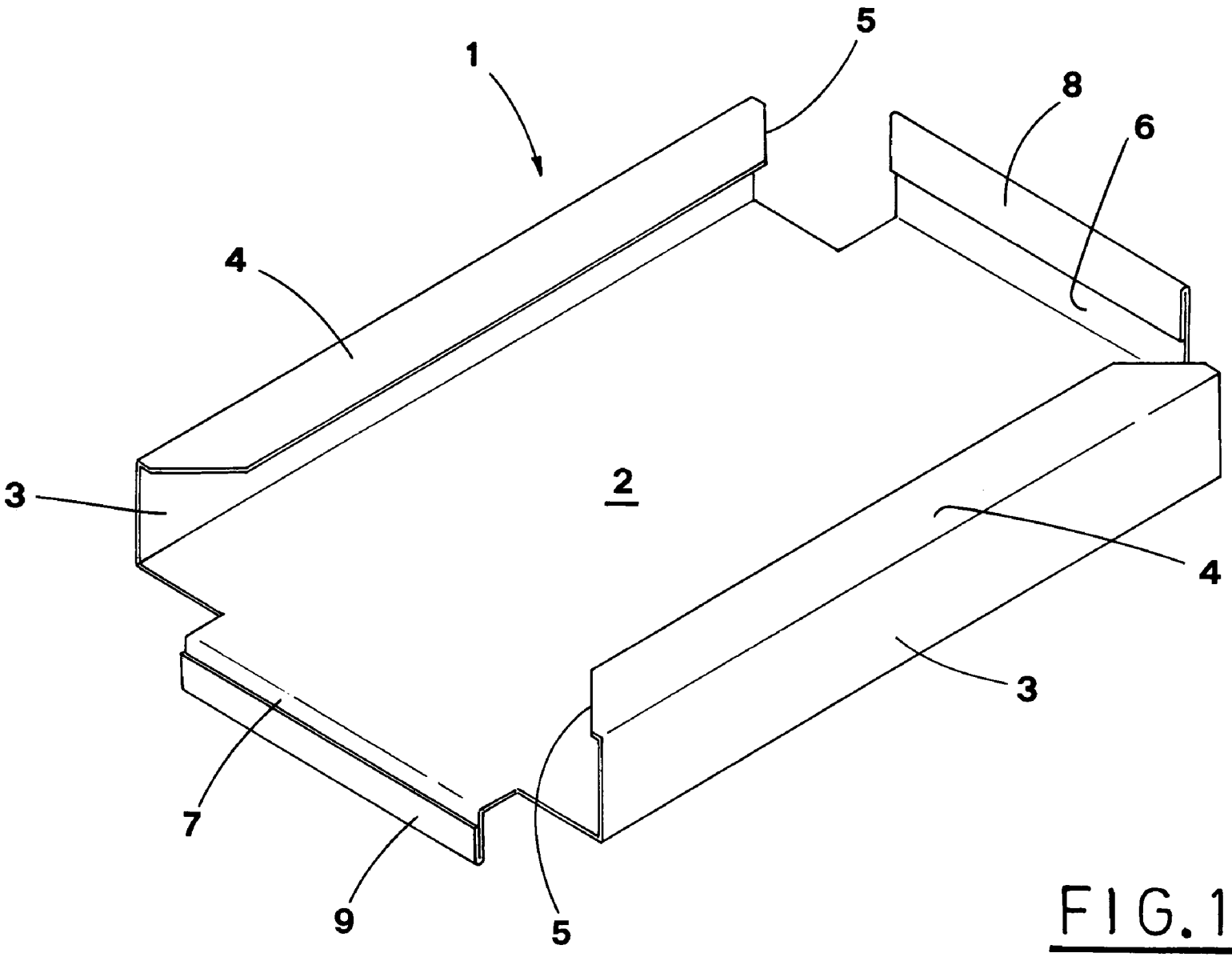
FIG. 1 illustrates a prospective view of the support device for cutting templates in object.

With particular reference to the figures, 1 refers to the support device for cutting templates, destined to be applied in a machine for cutting tubular-shaped textile products.

The cutting template support device is constituted by a panel 2 obtained from a sheet of metal 10 such as stainless steel, suitably shaped according to the outline shown in FIG. 4; the metal sheet 10 is subsequently folded in such a way as to form a sort of drawer. In particular, the panel 2 has a substantially rectangular shape and along the longitudinal sides has raised rims 3; the longitudinal rims 3 have an edge 4 folded towards the centre of the panel 2, in such a way as to serve as a guide for sliding it onto the press.

The edges 4 of the longitudinal rims 3 have respective bevels 5 at the respective ends. The bevels 5 cut the outer corners of the edges 4 at an angle of 45°.

Along the transversal sides, on the other hand, the panel 2 presents further rims 6, 7 folded perpendicularly to the plane of the same panel 2. In particular, the front rim 6 is raised in the same direction as the longitudinal rims 3, in other words upwards when in an operative set-up on the press, and is destined to act as a handle of the support device. The frontal rim 6 usefully presents a crushed fold stretch 8, obtained by folding a marginal portion on to the inner face of the same rim 6.

The rear rim 7 is folded downwards, in other words from the opposite side of the panel 2 to the rims 3 and 6. The rear rim 7 in turn presents a stretch of crushed fold 9, obtained by a marginal portion on to the outer face of the same rim 7.

It should be pointed out that the longitudinal rims 3 and the transversal rims 6, 7 do not stretch for the entire length of the corresponding sides of the panel 2, as they do not affect the corner area of the panel 2. Usefully it is foreseen that these corner areas be removed, as shown in FIG. 3.

The functioning of the support device for cutting templates is easily understandable from the above description.

The support device for cutting templates achieves the purpose of creating a considerable reduction in production costs, in particular thanks to considerable material savings and an optimisation of the work processes required.

This can be obtained essentially thanks to the production of the bevels 5 at the ends of the portions 13 of the metal sheet 10 destined to form the edge 4 of the longitudinal rims 3 (see FIG. 4). Such bevels 5 determine a considerable reduction in the material used, preferably stainless steel, as can be seen in comparison with in the plan development drawing of a conventional template holder illustrated in FIG. 5. For greater clarity, in FIG. 5 the dotted area 15 represents the portion of metal sheet of conventional template holders that are removed in the template holder in object, in correspondence with each of the four corners of the longitudinal rims, thanks to the creation of the bevels 5 and therefore the relative greater consumption of material in the conventional template holders.

This saving of material is obviously more significant considering the high number of template holders normally used by sector industries and the high frequency with which they must be replaced.

The creation of the bevels 5 also has the advantage of considerably reducing the time required for the sheet 10 cutting operation, as the cutting organs, such as lasers, have to cover a shorter perimetral length than that of conventional template holders.

It should be pointed out that the bevels 5 also have the purpose of eliminating a cutting part from the device's grip area by the operator, so as to reduce the risk of cuts and the like. In addition to reducing production costs and improving the template holder device's functionality, it also contributes to producing the grip handle in a single piece with the panel 2, by the folding of a relative portion 16 of the metal sheet 10 (see again FIG. 4).

This brings about an obvious simplification of the production process, requiring only one process against the two required for conventional template holders, in which the grip handle is obtained from a separate piece of metal sheet, indicated with 26 in FIG. 5, which can subsequently be folded and fixed by welding to a corresponding transversal rim.

The welding of the grip handle also entails the overlapping of the two parts to be joined, which determines further greater consumption of material than the solution in object, in which the handle is produced in a single piece with panel 2. For greater clarity, in FIG. 5 the dotted area 17, represents the overlapping portion of the two parts to be welded for the production of the grip handle in conventional template holders and therefore the relative greater consumption of materials.

Materials adopted for the actual realisation of the invention, as well as their shapes and sizes can be various, depending on the requirements.

The invention claimed is:

1. A support device for cutting templates, the device comprising:

a panel of sheet metal having a substantially rectangular shaped portion, a first longitudinal rim portion, a second longitudinal rim portion and a frontal rim portion providing a prefolded panel outline, said first longitudinal rim portion being located along a first longitudinal side of said rectangular shaped portion, said second longitudinal rim portion extending along a second longitudinal side of said rectangular shaped portion, said panel being folded such that said first longitudinal rim portion is perpendicular to said rectangular shaped portion to form a first raised rim portion and said second longitudinal rim portion is perpendicular to said rectangular shaped portion to form a second raised rim portion and said frontal rim portion is perpendicular to said rectangular shaped portion to define a handle, whereby said rectangular shaped portion, said raised rim portions and said handle form a disposable support device structure for supporting a shaped blade in a cutting machine, said first raised rim portion defining a first cutting machine guide element and said second raised rim portion defining a second cutting machine guide element for guiding said support device structure into the cutting machine as said support device structure moves into the cutting machine, said frontal rim portion, said first longitudinal rim portion and said second longitudinal rim portion being folded in an upward direction such that said frontal rim portion, said first longitudinal rim and said second longitudinal rim are folded in the same direction, said panel having a rear rim portion located opposite said frontal rim portion, said rear rim portion being folded in a direction opposite the longitudinal rim portions.

2. The device according to claim 1, wherein said panel of sheet metal has beveled edges, said bevel edges reducing a perimeter of said prefolded panel outline, each beveled edge being located adjacent an outer corner defined by a portion of one of said longitudinal rim portions and a panel portion, said first longitudinal rim and said second longitudinal rim having an edge folded towards a center of said rectangular shaped portion of said panel such that one beveled edge is opposite another beveled edge.

3. The device according to claim 1, wherein said frontal rim portion has a rim portion, said rim portion being folded such that said rim portion is in contact with said frontal rim portion to form a crushed folded stretch portion.

4. The device according to claim 2, wherein each beveled edge is at an angle of 45° with respect to said edge of one of said longitudinal rim portions.

5. The device according to claim 1, wherein said rear rim portion has an external surface and a rim portion, said rim portion being folded such that said rim portion engages said external surface to form a crushed fold stretch portion.

6. The device according to claim 1, wherein said longitudinal rim portions and said frontal rim portion do not extend along the entire length of the corresponding sides of said panel, said first longitudinal rim portion and said frontal rim portion being spaced apart via a first corner portion defined by a first edge of said panel, said second longitudinal rim portion and said frontal rim portion being spaced apart via a second corner portion defined by a second edge of said panel.

7. The device according to claim 6, wherein said first raised rim portion is not in contact with said handle and said second raised rim portion is not in contact with said handle.

8. A support device for cutting templates, the device comprising:

a blank cut from an integral piece of sheet metal with predefined edges providing a prefolded blank outline, said blank having a rectangular portion connected to a first longitudinal rim portion, a second longitudinal rim portion and a front rim portion, said first longitudinal rim portion extending along a first longitudinal side of said rectangular portion, said second longitudinal rim portion extending along a second longitudinal side of said rectangular portion, said panel being folded such that said first longitudinal rim portion is perpendicular to said rectangular portion to form a first cutting machine guide element and said second longitudinal rim portion is perpendicular to said rectangular portion to form a second machine guide element and said frontal rim portion is perpendicular to said rectangular portion to define a handle, whereby said rectangular portion, said machine guide elements and said handle form a disposable support device structure for supporting a shaped cutting blade in a cutting machine, said first cutting machine guide element and said second cutting machine guide element guiding said support device structure into the cutting machine when said support device structure is transferred to the cutting machine, said front rim portion, said first longitudinal rim portion and said second longitudinal rim portion being folded in an upward direction such that said frontal rim portion, said first longitudinal rim and said second longitudinal rim are folded in the same direction, said panel having a rear rim portion located opposite said front rim portion, said rear rim portion being folded in a downward direction, said downward direction being opposite said upward direction.

9. The device according to claim 8, wherein said first longitudinal rim portion and said second longitudinal rim portion have beveled edges, said bevel edges reducing a perimeter of said prefolded blank outline, each beveled edge being located adjacent an outer corner defined by a portion of one of said longitudinal rim portions and a portion of said panel, said first longitudinal rim portion and said second longitudinal rim portion having a longitudinal portion folded towards a center of said rectangular portion such that one beveled edge is opposite another beveled edge.

10. The device according to claim 8, wherein said front rim portion has a rim portion, said rim portion being folded such that said rim portion is in contact with said front rim portion to form a front rim folded stretch portion.

11. The device according to claim 9, wherein each beveled edge is at an angle of 45° with respect to an edge of one of said longitudinal rim portions.

12. The device according to claim 9, wherein said rear rim portion has an external surface and a rim portion, said rim portion being folded such that said rim portion engages said external surface to form a folded rim portion stretch.

13. The device according to claim 8, said longitudinal rim portions and said front rim portion extend along a portion of corresponding side of said panel, said first longitudinal rim portion and said front rim portion being spaced apart via a first corner portion defined by a first edge of said panel, said second longitudinal rim portion and said front rim portion being spaced apart via a second corner portion defined by a second edge of said panel.

14. The device according to claim 13, wherein said first cutting machine guide element is not in contact with said handle and said second cutting machine guide element is not in contact with said handle, said first cutting machine guide element being opposite said second cutting machine guide element.

15. A support device for cutting templates, the device comprising:

an integral piece of sheet metal cut such that said sheet metal piece has a rectangular center portion integrally connected to a first longitudinal rim portion, a second longitudinal rim portion, a rear rim portion and a front rim portion, whereby said rectangular center portion, said first longitudinal rim portion, said second longitudinal rim portion, said rear rim portion and said front rim portion have predefined edges to provide a prefolded sheet metal outline, said first longitudinal rim portion extending along a first longitudinal side of said rectangular center portion, said second longitudinal rim portion extending along a second longitudinal side of said rectangular center portion, said piece of sheet metal being folded in an upward direction such that said first longitudinal rim portion is perpendicular to said rectangular center portion to form a first cutting machine guide element means and said second longitudinal rim portion is perpendicular to said rectangular center portion to form a second machine guide element means and said frontal rim portion is perpendicular to said rectangular center portion to define a handle, whereby said rectangular center portion, said first longitudinal rim portion, said second longitudinal rim portion and said frontal rim portion extending in said upward direction, said rear rim portion being folded in a downward direction such that said rear rim portion extends in a direction opposite said upward direction of said first longitudinal rim portion, said second longitudinal rim portion and said frontal rim portion, said cutting machine guide elements, said rear rim portion and said handle forming a disposable support device structure means for supporting a shaped cutting device in a cutting machine, said first cutting machine guide element means and said second cutting machine guide element means for guiding said support device structure into the cutting machine when said support device structure is moved into the cutting machine, said first cutting machine guide element means having first beveled edges, said second cutting machine guide element means having second beveled edges, each first beveled edge being opposite one of said second beveled edges.

16. The device according to claim 15, wherein said longitudinal rim portions and said front rim portion extend along a portion of a corresponding side of said rectangular center portion, said first longitudinal rim portion and said front rim portion being spaced apart via a first corner portion defined by a first edge of said piece of sheet metal, said second longitudinal rim portion and said front rim portion being spaced apart via a second corner portion defined by a second edge of said piece of sheet metal, each first beveled edge being at an angle of 45° with respect to an edge of said first longitudinal rim portion, each second beveled edge being at an angle of 45° with respect to an edge of said second longitudinal rim portion.

* * * * *

US007533554C1

(12) EX PARTE REEXAMINATION CERTIFICATE (7849th)

United States Patent

Cortese

(10) Number: US 7,533,554 C1

(45) Certificate Issued: Nov. 2, 2010

(54) SUPPORT DEVICE FOR CUTTING TEMPLATES

(75) Inventor: Carmelo Angelo Cortese, Sasso Marconi (IT)

(73) Assignee: Cortese S.p.A., Bologna (IT)

Reexamination Request:
No. 90/010,712, Nov. 11, 2009

Reexamination Certificate for:

| | |
|---|---|
| Patent No.: | **7,533,554** |
| Issued: | **May 19, 2009** |
| Appl. No.: | **10/489,981** |
| Filed: | **Mar. 17, 2004** |

(22) PCT Filed: Oct. 8, 2003

(86) PCT No.: PCT/IT03/00603

§ 371 (c)(1), (2), (4) Date: Mar. 17, 2004

(87) PCT Pub. No.: WO2004/043660

PCT Pub. Date: May 27, 2004

(30) Foreign Application Priority Data

Nov. 14, 2002 (IT) ..... BO2002A0718

(51) Int. Cl.
*B21D 31/00* (2006.01)

(52) U.S. Cl. ..... 72/379.2

(58) Field of Classification Search ..... None
See application file for complete search history.

(56) References Cited

U.S. PATENT DOCUMENTS 6,478,391 B1 11/2002 Stoever

FOREIGN PATENT DOCUMENTS

| | | |
|---|---|---|
| GB | 2286960 | 9/1995 |
| JP | 401095818 | 4/1989 |

*Primary Examiner*—William C Doerrler

(57) ABSTRACT

The support device for cutting templates comprises a panel (2) with an essentially rectangular shape and presenting along the longitudinal sides respective raised rims (3) that serve as guides for sliding it into a cutting machine. The longitudinal rims (3) are fitted with an edge (4) that is folded towards the center of the panel (2), presenting the respective bevels (5) at the opposite ends in the corners. The panel (2) has a front rim (6) produced by folding the same panel (2) in a single piece and destined to function as the support device's handle.

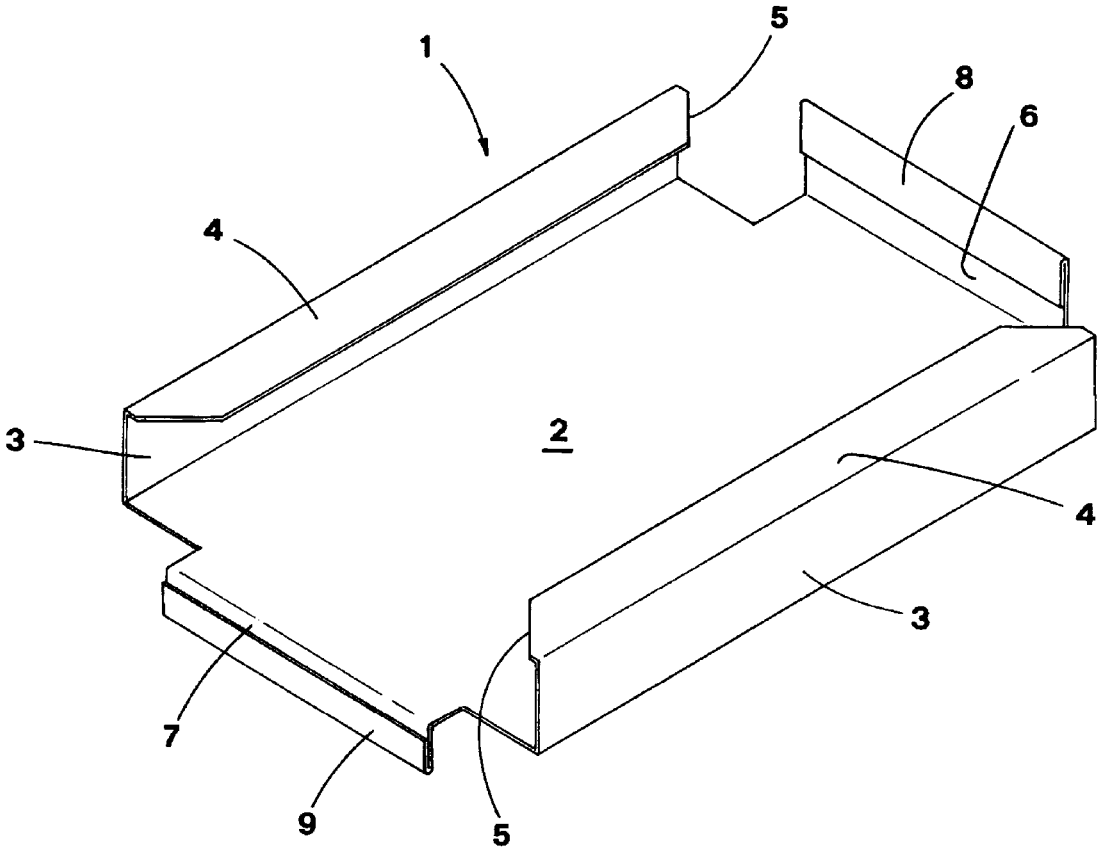

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-14 and 16 are cancelled.

Claim 15 is determined to be patentable as amended.

New claims 17-20 are added and determined to be patentable.

15. A support device for cutting templates, the device comprising:

an integral piece of sheet metal cut such that said sheet metal piece has a rectangular center portion integrally connected to a first longitudinal rim portion, a second longitudinal rim portion, a rear rim portion and a front rim portion, whereby said rectangular center portion, said first longitudinal rim portion, said second longitudinal rim portion, said rear rim portion and said front rim portion have predefined edges to provide a prefolded sheet metal outline, said first longitudinal rim portion extending along a first longitudinal side of said rectangular center portion, said second longitudinal rim portion extending along a second longitudinal side of said rectangular center portion, said piece of sheet metal being folded in an upward direction such that said first longitudinal rim portion is perpendicular to said rectangular center portion to form a first cutting machine guide element means and said second longitudinal rim portion is perpendicular to said rectangular center portion to form a second machine guide-element means and said frontal rim portion is perpendicular to said rectangular center portion to define a handle, whereby said rectangular center portion, said first longitudinal rim portion, said second longitudinal rim portion and said frontal rim portion extending in said upward direction, said rear rim portion being folded in a downward direction such that said rear rim portion extends in a direction opposite said upward direction of said first longitudinal rim portion, said second longitudinal rim portion and said frontal rim portion, said cutting machine guide elements, said rear rim portion and said handle forming a disposable support device structure means for supporting a shaped cutting device in a cutting machine, said first cutting machine guide element means and said second cutting machine guide element means for guiding said support device structure into the cutting machine when said support device structure is moved into the cutting machine, said first cutting machine guide element means having first beveled edges, said second cutting machine guide element means having second beveled edges, each first beveled edge being opposite one of said second beveled edges, *wherein said longitudinal rim portions and said front rim portion extend along a portion of a corresponding side of said rectangular center portion, said first longitudinal rim portion and said front rim portion being spaced apart via a first corner portion defined by a first edge of said piece of sheet metal, said second longitudinal rim portion and said front rim portion being spaced apart via a second corner portion defined by a second edge of said piece of sheet metal, each first beveled edge being at an angle of 45° with respect to an edge of said first longitudinal rim portion, each second beveled edge being at an angle of 45° with respect to an edge of said second longitudinal rim portion.*

*17. A support device for cutting templates, the device comprising:*

*a panel of sheet metal having a substantially rectangular shaped portion, a first longitudinal rim portion, a second longitudinal rim portion and a frontal rim portion providing a prefolded panel outline, said first longitudinal rim portion being located along a first longitudinal side of said rectangular shaped portion, said second longitudinal rim portion extending along a second longitudinal side of said rectangular shaped portion, said panel being folded such that said first longitudinal rim portion is perpendicular to said rectangular shaped portion to form a first raised rim portion and said second longitudinal rim portion is perpendicular to said rectangular shaped portion to form a second raised rim portion and said frontal rim portion is perpendicular to said rectangular shaped portion to define a handle, whereby said rectangular shaped portion, said raised rim portions and said handle form a disposable support device structure for supporting a shaped blade in a cutting machine, said first raised rim portion defining a first cutting machine guide element and said second raised rim portion defining a second cutting machine guide element for guiding said support device structure into the cutting machine as said support device structure moves into the cutting machine, said frontal rim portion, said first longitudinal rim portion and said second longitudinal rim portion being folded in an upward direction such that said frontal rim portion, said first longitudinal rim and said second longitudinal rim are folded in the same direction, said panel having a rear rim portion located opposite said frontal rim portion, said rear rim portion being folded in a direction opposite the longitudinal rim portions, wherein said longitudinal rim portions and said frontal rim portion extend along a portion of a corresponding side of said rectangular center portion, said first longitudinal rim portion having first beveled edges, said second longitudinal rim portion having second beveled edges, said first longitudinal rim portion and said frontal rim portion being spaced apart via a first corner portion defined by a first edge of said panel of sheet metal, said second longitudinal rim portion and said frontal rim portion being spaced apart via a second corner portion defined by a second edge of said piece of sheet metal, each of said first beveled edges being at an angle of 45° with respect to an edge of said first longitudinal rim portion, each of said second beveled edges being at an angle of 45° with respect to an edge of said second longitudinal rim portion.*

*18. A support device for cutting templates, the device comprising:*

*a blank cut from an integral piece of sheet metal with predefined edges providing a prefolded blank outline, said blank having a rectangular portion connected to a first longitudinal rim portion, a second longitudinal rim*

*portion and a front rim portion, said first longitudinal rim portion extending along a first longitudinal side of said rectangular portion, said second longitudinal rim portion extending along a second longitudinal side of said rectangular portion, said panel being folded such that said first longitudinal rim portion is perpendicular to said rectangular portion to form a first cutting machine guide element and said second longitudinal rim portion is perpendicular to said rectangular portion to form a second machine guide element and said frontal rim portion is perpendicular to said rectangular portion to define a handle, whereby said rectangular portion, said machine guide elements and said handle form a disposable support device structure for supporting a shaped cutting blade in a cutting machine, said first cutting machine guide element and said second cutting machine guide element guiding said support device structure into the cutting machine when said support device structure is transferred to the cutting machine, said front rim portion, said first longitudinal rim portion and said second longitudinal rim portion being folded in an upward direction such that said frontal rim portion, said first longitudinal rim and said second longitudinal rim are folded in the same direction, said panel having a rear rim portion located opposite said front rim portion, said rear rim portion being folded in a downward direction, said downward direction being opposite said upward direction, wherein said longitudinal rim portions and said front rim portion extend along a portion of a corresponding side of said rectangular center portion, said first longitudinal rim portion having first beveled edges, said second longitudinal rim portion having second beveled edges, said first longitudinal rim portion and said front rim portion being spaced apart via a first corner portion defined by a first edge of said piece of sheet metal, said second longitudinal rim portion and said front rim portion being spaced apart via a second corner portion defined by a second edge of said piece of sheet metal, each of said first beveled edges being at an angle of 45° with respect to an edge of said first longitudinal rim portion, each of said second beveled edges being at an angle of 45° with respect to an edge of said second longitudinal rim portion.*

*19. A support device for cutting templates, the device comprising:*

*a panel of sheet metal having a substantially rectangular shaped portion, a first longitudinal rim portion, a second longitudinal rim portion and a frontal rim portion providing a prefolded panel outline, said first longitudinal rim portion being located along a first longitudinal side of said rectangular shaped portion, said second longitudinal rim portion extending along a second longitudinal side of said rectangular shaped portion, said panel being folded such that said first longitudinal rim portion is perpendicular to said rectangular shaped portion to form a first raised rim portion and said second longitudinal rim portion is perpendicular to said rectangular shaped portion to form a second raised rim portion and said frontal rim portion is perpendicular to said rectangular shaped portion to define a handle, whereby said rectangular shaped portion, said raised rim portions and said handle form a disposable support device structure for supporting a shaped blade in a cutting machine, said first raised rim portion defining a first cutting machine guide element and said second raised rim portion defining a second cutting machine guide element for guiding said support device structure into the cutting machine as said support device structure moves into the cutting machine, said frontal rim portion, said first longitudinal rim portion and said second longitudinal rim portion being folded in an upward direction such that said frontal rim portion, said first longitudinal rim and said second longitudinal rim are folded in the same direction, said panel having a rear rim portion located opposite said frontal rim portion, said rear rim portion being folded in a direction opposite the longitudinal rim portions, wherein said first longitudinal rim portion comprises a first edge portion, said first edge portion being essentially perpendicular to said first longitudinal rim portion, said first edge portion comprising at least one first beveled edge, said second longitudinal rim portion comprising a second edge portion, said second edge portion being essentially perpendicular to said second longitudinal rim portion, said second edge portion comprising at least one second beveled edge, said first longitudinal rim portion being located at a spaced location from said second longitudinal rim portion, said frontal rim portion being located at a spaced location from said first longitudinal rim portion and said second longitudinal rim portion.*

*20. A support device for cutting templates, the device comprising:*

*a blank cut from an integral piece of sheet metal with predefined edges providing a prefolded blank outline, said blank having a rectangular portion connected to a first longitudinal rim portion, a second longitudinal rim portion and a front rim portion, said first longitudinal rim portion extending along a first longitudinal side of said rectangular portion, said second longitudinal rim portion extending along a second longitudinal side of said rectangular portion, said panel being folded such that said first longitudinal rim portion is perpendicular to said rectangular portion to form a first cutting machine guide element and said second longitudinal rim portion is perpendicular to said rectangular portion to form a second machine guide element and said frontal rim portion is perpendicular to said rectangular portion to define a handle, whereby said rectangular portion, said machine guide elements and said handle form a disposable support device structure for supporting a shaped cutting blade in a cutting machine, said first cutting machine guide element and said second cutting machine guide element guiding said support device structure into the cutting machine when said support device structure is transferred to the cutting machine, said front rim portion, said first longitudinal rim portion and said second longitudinal rim portion being folded in an upward direction such that said frontal rim portion, said first longitudinal rim and said second longitudinal rim are folded in the same direction, said panel having a rear rim portion located opposite said front rim portion, said rear rim portion being folded in a downward direction, said downward direction being opposite said upward direction, wherein said first longitudinal rim portion comprises a first edge portion, said first edge portion being essentially perpendicular to said first longitudinal rim portion, said first edge portion comprising at least one first beveled edge, said second longitudinal rim portion comprising a second edge portion, said second edge portion being essentially perpendicular to said second longitudinal rim portion, said second edge portion comprising at*

*least one second beveled edge, said first longitudinal rim portion being located at a spaced location from said second longitudinal rim portion, said front rim portion being located at a spaced location from said first longitudinal rim portion and said second longitudinal rim portion.*

* * * * *